US007238040B1

(12) United States Patent
Wu

(10) Patent No.: US 7,238,040 B1
(45) Date of Patent: Jul. 3, 2007

(54) CABLE CONNECTOR ASSEMBLY WITH LATCHING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,132

(22) Filed: Jul. 3, 2006

Related U.S. Application Data

(63) Continuation-in-part of application No. 11/201,521, filed on Aug. 11, 2005, now Pat. No. 7,114,980.

(51) Int. Cl.
*H01R 13/627* (2006.01)

(52) U.S. Cl. ..... 439/352

(58) Field of Classification Search ..... 439/350–358
See application file for complete search history.

(56) References Cited

U.S. PATENT DOCUMENTS 4,717,351 A * 1/1988 McCormick ..... 439/153
5,531,612 A 7/1996 Goodall et al.
5,564,939 A 10/1996 Maitani et al.
5,761,805 A 6/1998 Guyer
5,766,033 A 6/1998 Davis
5,797,771 A 8/1998 Garside
6,071,149 A 6/2000 Hara
6,165,006 A 12/2000 Yeh et al.
6,183,273 B1 2/2001 Yu et al.
6,193,547 B1 2/2001 Tung
6,227,904 B1 5/2001 Wang et al.
6,447,170 B1 * 9/2002 Takahashi et al. ..... 385/53
6,524,130 B1 2/2003 Yeh
6,648,665 B1 11/2003 Wu
6,659,790 B1 12/2003 Wu
6,736,676 B2 5/2004 Zhang et al.
6,749,458 B1 6/2004 Kuo et al.
6,866,533 B2 3/2005 Wu
6,887,091 B1 5/2005 Wu
6,887,101 B2 5/2005 Ito et al.
6,896,542 B2 5/2005 Chang

* cited by examiner

*Primary Examiner*—Ross Gushi
(74) *Attorney, Agent, or Firm*—Wei Te Chung

(57) ABSTRACT

A cable connector assembly (100) includes a housing (1), a PCB (2) received in the housing, a cable (7) electrically connecting with the PCB, a pulling member (32) moveable relative to the housing in a horizontal direction, a latch member (31) discrete from the pulling member and assembled to the housing for latch with a complementary connector, and a pull tape (33) discrete from the pulling member and assembled to the pulling member. The latch member includes an engaging portion (310) assembled to the housing, a connecting portion (312) extending from the engaging portion and capable of being actuated by the pulling member, and a latch portion (311) extending from at least one of the engaging portion and the connecting portion for latching with the complementary connector.

20 Claims, 9 Drawing Sheets

CABLE CONNECTOR ASSEMBLY WITH LATCHING MECHANISM

CROSS-REFERENCE TO RELATED APPLICATIONS

This application is related to U.S. patent application Ser. No. 11/201,521 filed on Aug. 11, 2005 and entitled "CABLE CONNECTOR ASSEMBLY WITH LATCHING MECHANISM", U.S. patent application Ser. No. 11/201,461 filed on Aug. 11, 2005 and entitled "CABLE CONNECTOR ASSEMBLY WITH LATCHING MECHANISM", U.S. patent application Ser. No. 11/268,906 filed on Nov. 8, 2005 and entitled "CABLE CONNECTOR ASSEMBLY WITH LATCHING MECHANISM", U.S. patent application Ser. No. 11/268,902 filed on Nov. 8, 2005 and entitled "JUXTAPOSED CABLE CONNECTOR ASSEMBLIES", and U.S. patent application Ser. No. 11/322,692 filed on Dec. 30, 2005 and entitled "STACKED CONNECTOR ASSEMBLY", and U.S. patent application Ser. No. 11/213,048 filed on Aug. 26, 2005 and entitled "CABLE CONNECTOR ASSEMBLY WITH EMI GASKET", all of which have the same applicant and assignee as the present invention. The disclosure of these related applications is incorporated herein by reference. The present invention is a CIP (continuation-in-part) of U.S. patent application Ser. No. 11/201,521 filed on Aug. 11, 2005.

BACKGROUND OF THE INVENTION

1. Field of the Invention

The present invention generally relates to a cable connector assembly, and more particularly to a cable connector assembly used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8088 defines matable Compact Multilane Shielded connectors adopted for being used in laptop portable computer to connect small-size disk drives to a printed circuit board. The connectors comprise a cable connector assembly connecting with the small-size drive and a header mounted on the printed circuit board. The cable connector assembly defined in the specification comprises a pair of engagble metal housings together defining a receiving space therebetween, a PCB received in the receiving space, a cable comprising a plurality of conductors electrically connecting with the PCB, and a latching mechanism assembled to a top surface of the upper metal housing. The latching mechanism comprises an elongated T-shape latch member for latching with the header mentioned above and a pulling member cooperating with the latch member for actuating the latch member to separate from the header. The latch member is assembled to a rear portion of a base of the upper housing with latch portion exposed beyond a front portion of the base of the upper housing to locate above a tongue portion of the upper housing. However, such elongated latch member is hard to be actuated by the pulling member, otherwise the latch member must have enough thickness or made by high-quality material having enough rigidity to achieve the goal of latching reliably and unlatching easily.

Hence, an improved cable connector assembly is provided in the present invention to address the problems mentioned above and meet the current trend.

BRIEF SUMMARY OF THE INVENTION

Accordingly, an object of the present invention is to provide a cable connector assembly which latches with a complementary connector reliably and unlatches from the complementary connector easily.

In order to achieve the above-mentioned object, a cable connector assembly in accordance with the present invention comprises a housing, a PCB received in the housing, a cable electrically connecting with the PCB, a pulling member moveable relative to the housing in a horizontal direction, a latch member discrete from the pulling member and assembled to the housing for latching with a complementary connector, and a pull tape assembled to at least one of the pulling member and the latch member. The latch member comprises an engaging portion assembled to the housing, a connecting portion extending from the engaging portion and a front latching portion extending from at least one of the engaging portion and the connecting portion.

Other objects, advantages and novel features of the invention will become more apparent from the following detailed description of the present embodiment when taken in conjunction with the accompanying drawings.

DETAILED DESCRIPTION OF THE INVENTION

Figure 1:
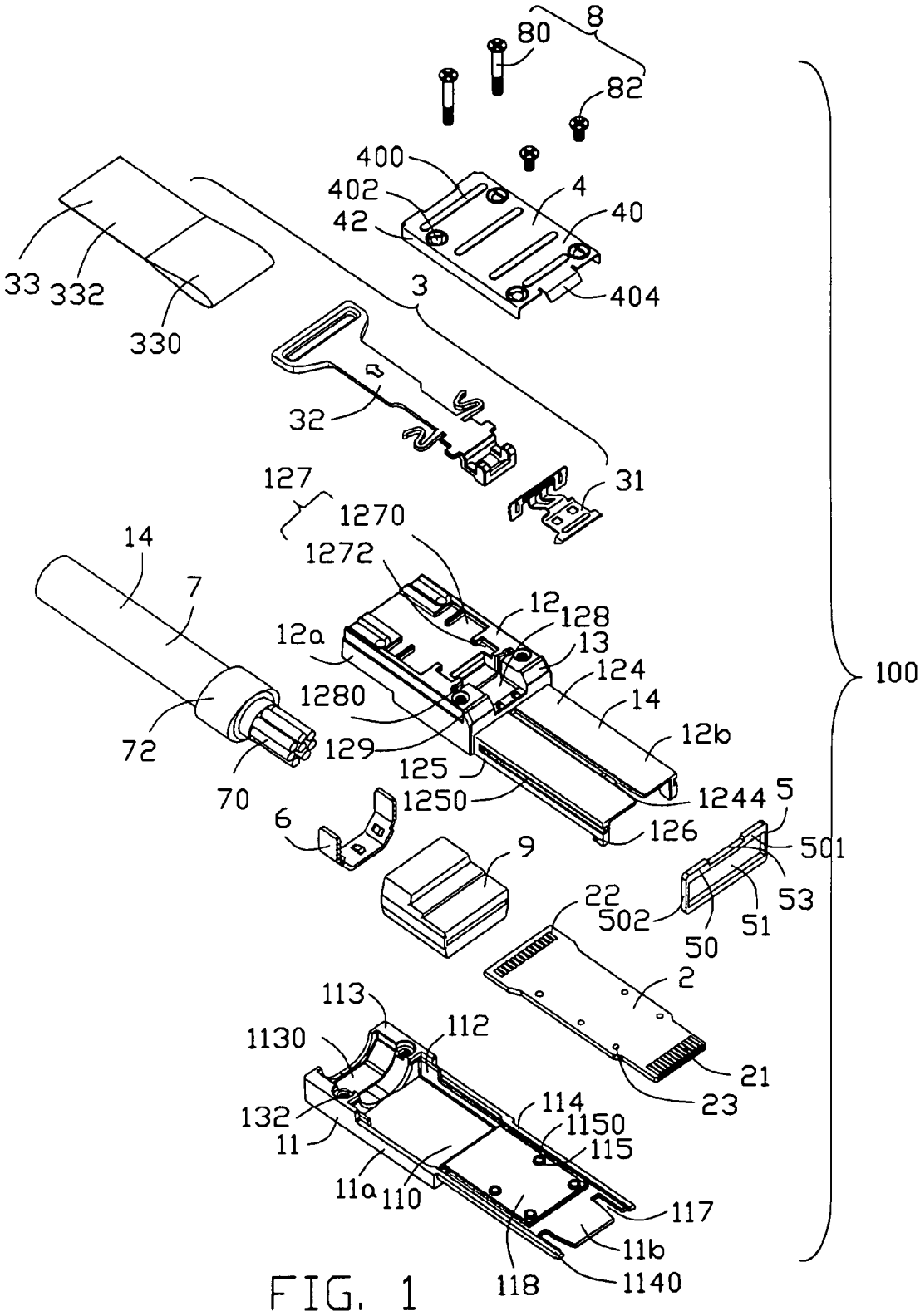
FIG. 1 is an assembled, perspective view of a cable connector assembly in accordance with the present invention.

Reference will now be made to the drawing figures to describe the present invention in detail.

Figure 2:
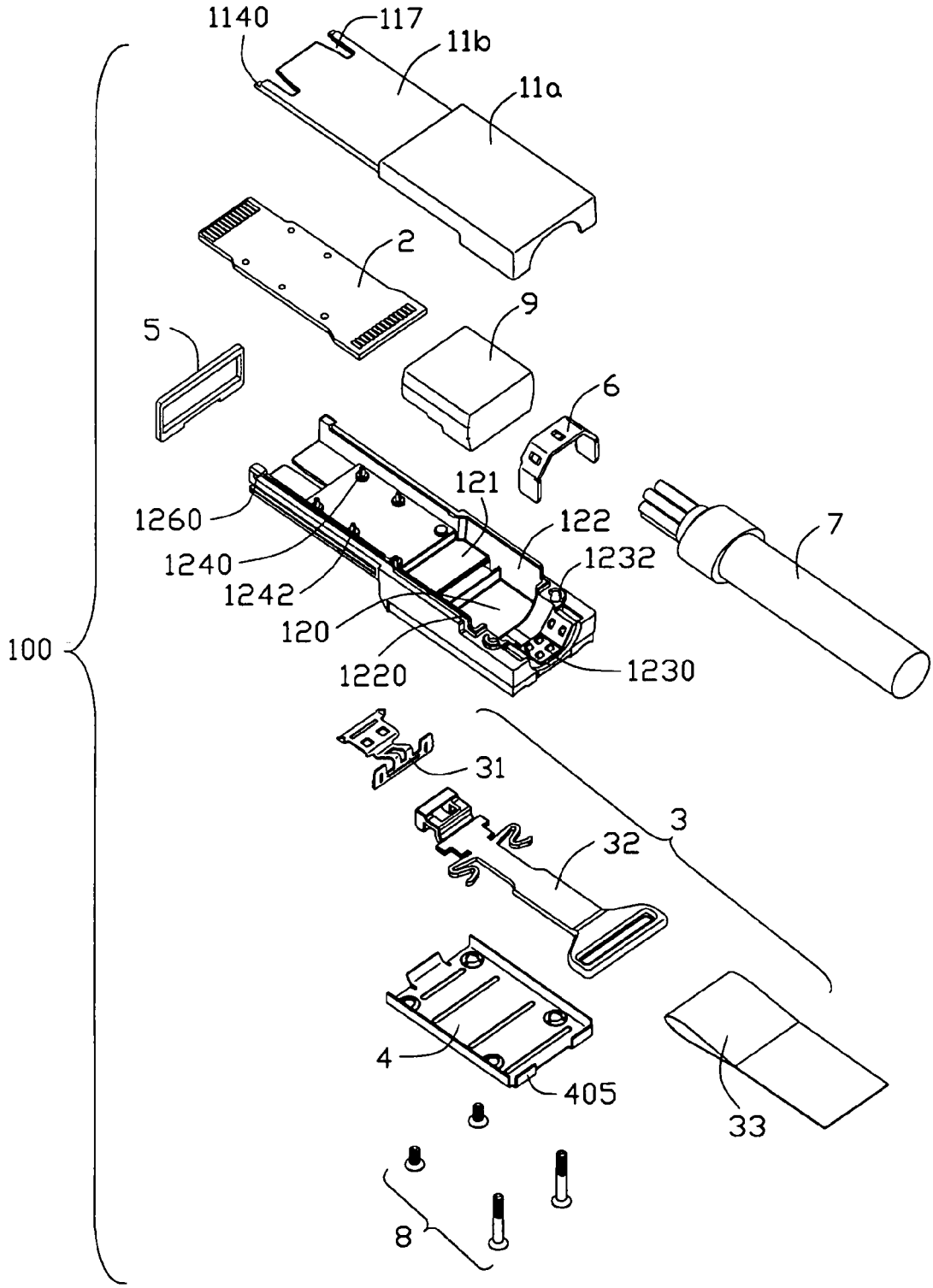
FIG. 2 is a view similar to FIG. 1, but viewed from a different aspect.
Figure 3:
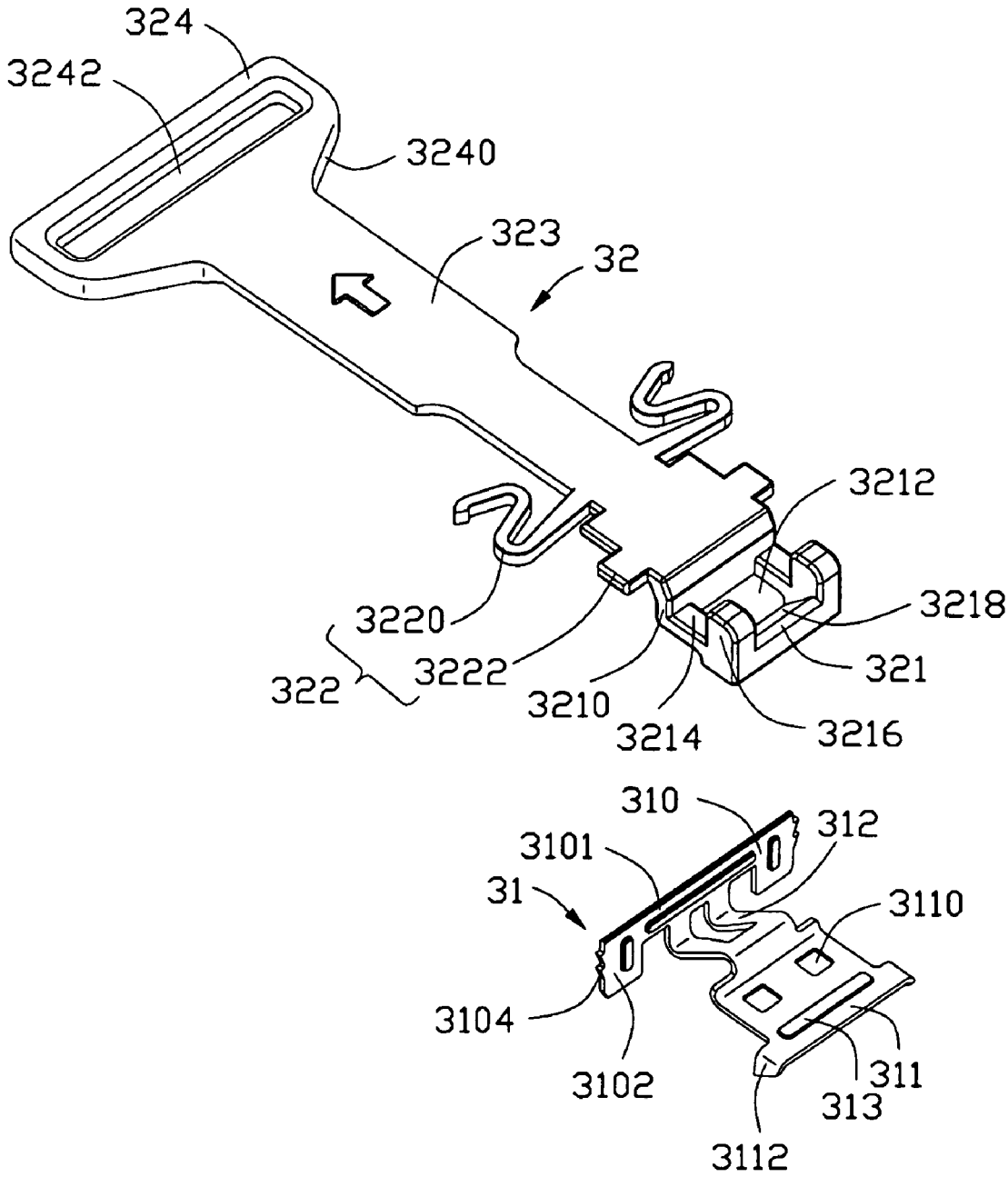
FIG. 3 is an enlarged view of a latch member and a pulling member of the cable connector assembly of FIG. 1.
Figure 4:
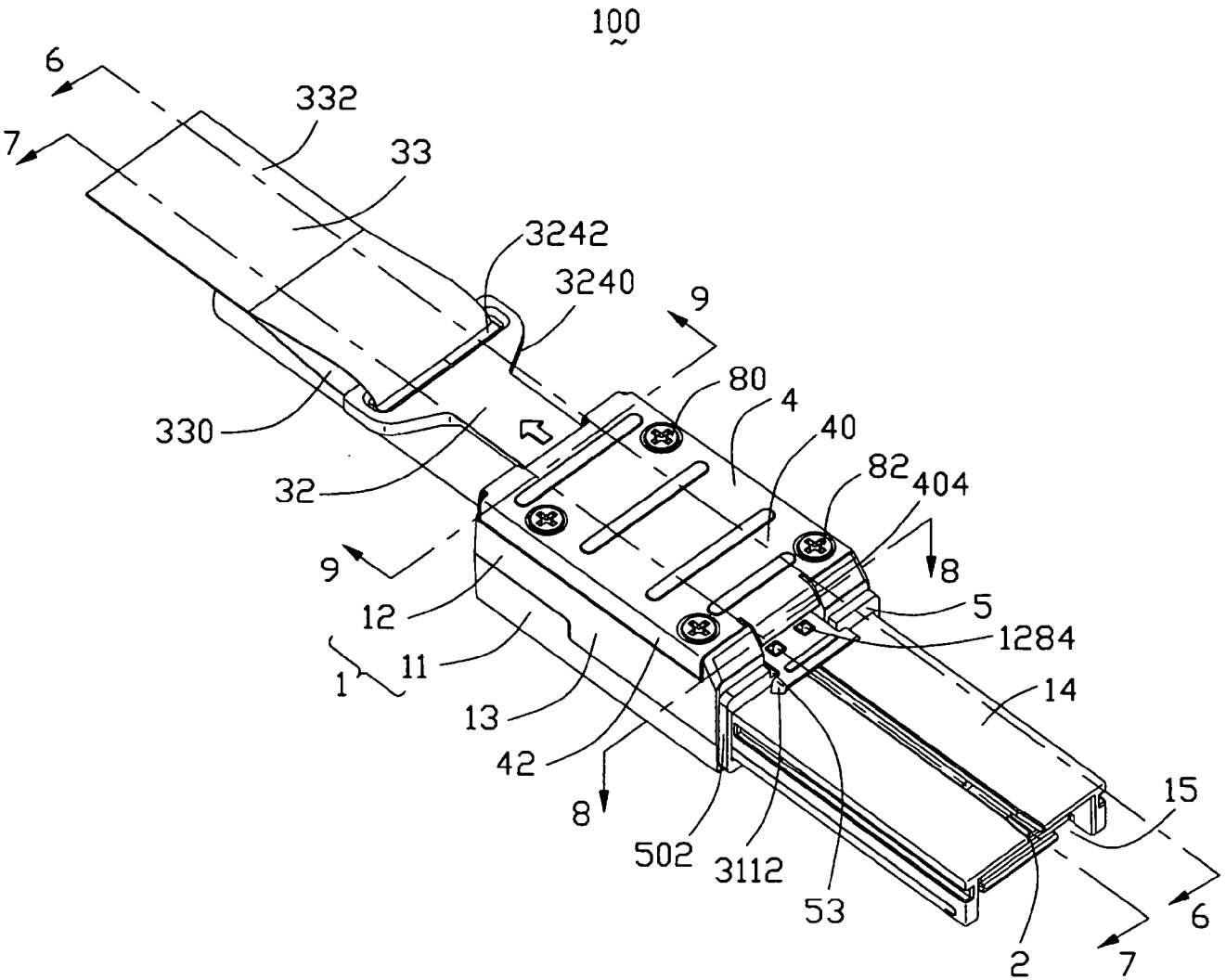
FIG. 4 is an assembled view of FIG. 1.
Figure 5:
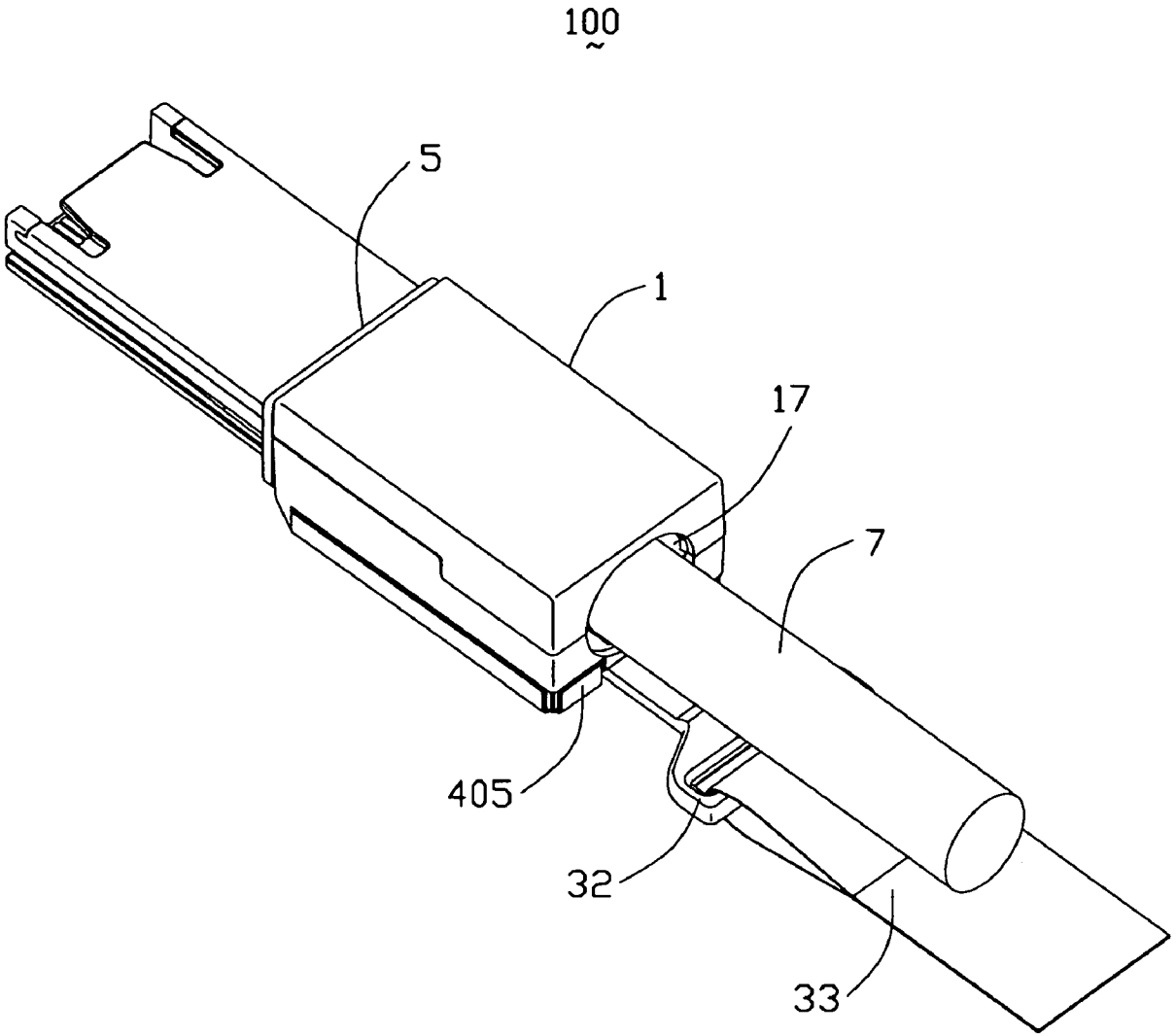
FIG. 5 is a view similar to FIG. 4, but viewed from a different aspect.
Figure 6:
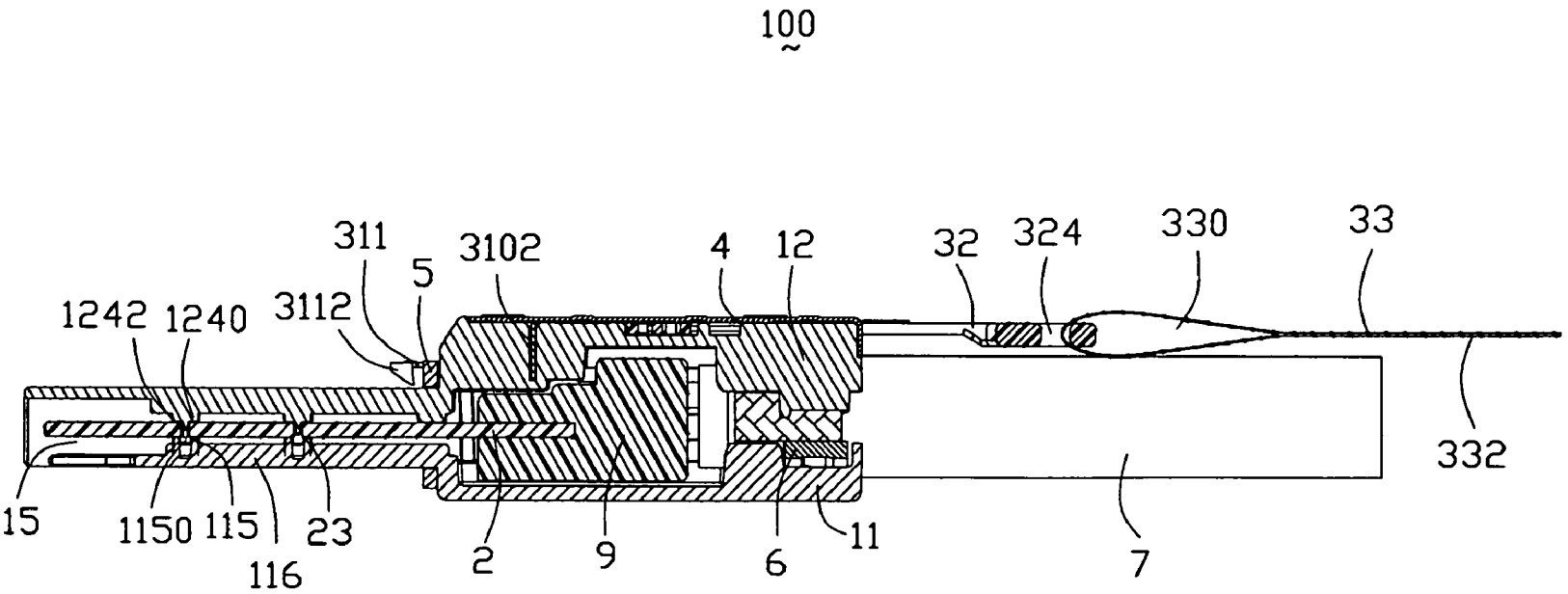
FIGS. 6–9 are cross-section views taken along lines 6—6 to 9—9 of FIG. 4.
Figure 7:
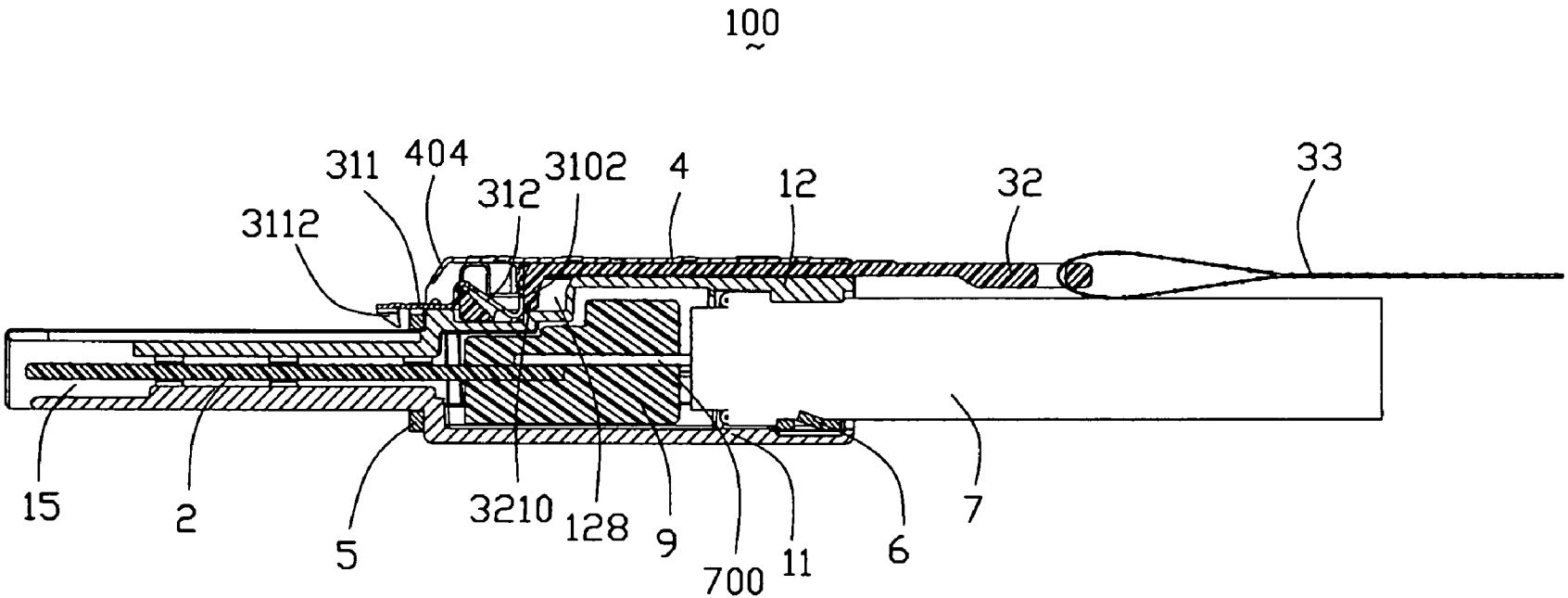
Figure 8:
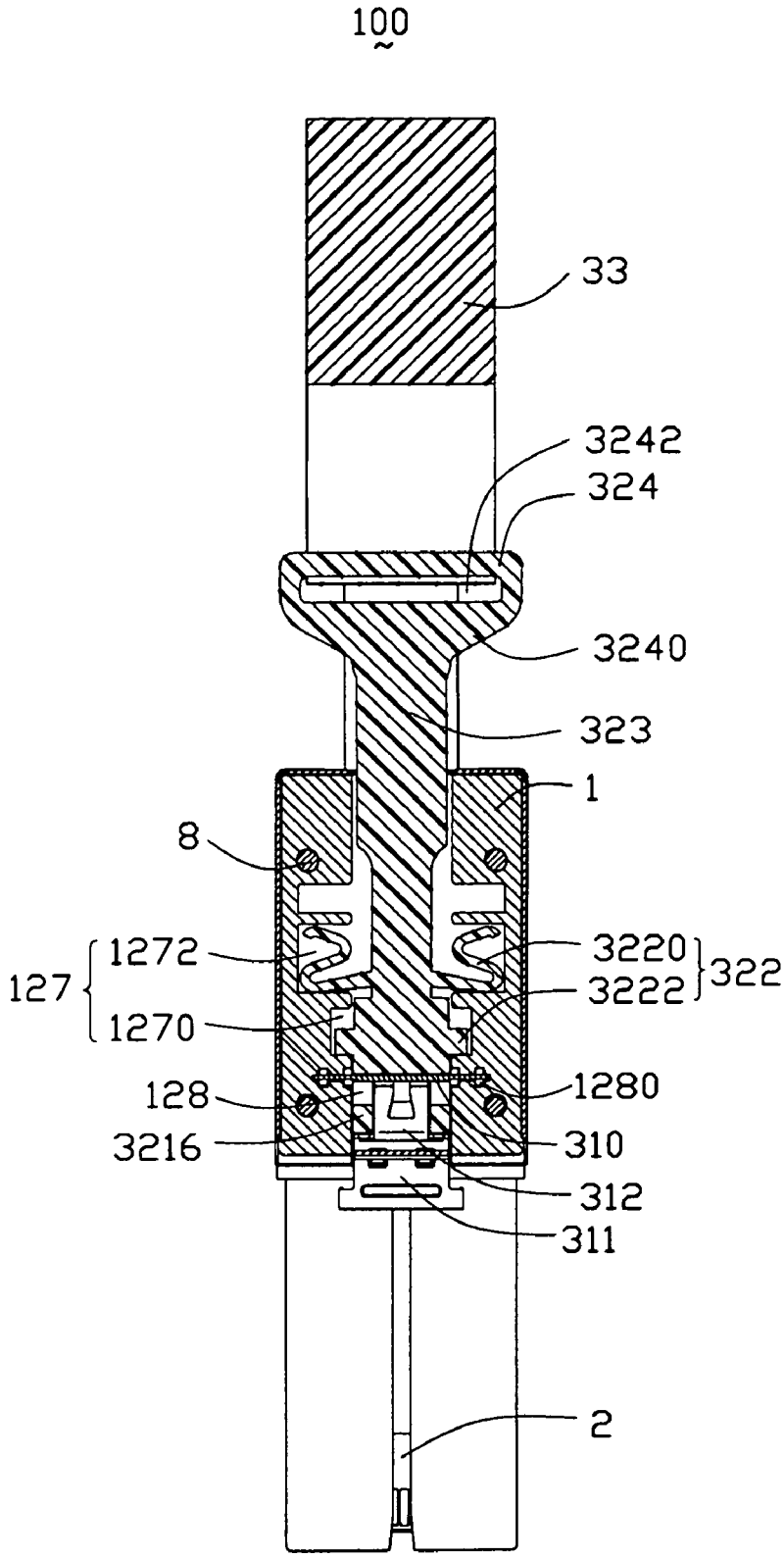
Figure 9:
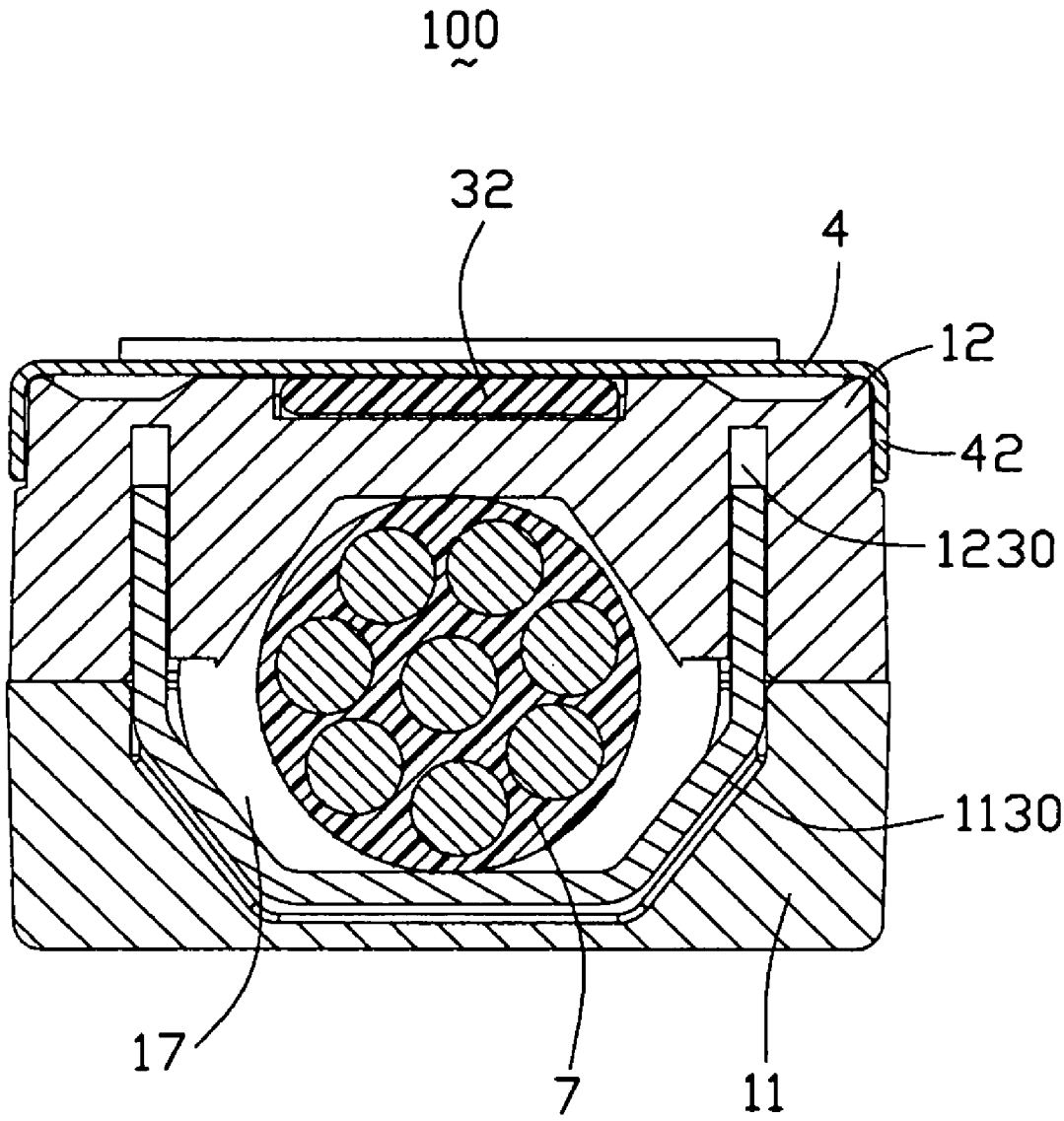

Referring to FIGS. 1–3, a cable connector assembly 100 in accordance with the present invention comprises a housing 1, a printed circuit board (PCB) 2 located in the housing 1, a cable 7 with a cable holder 6 electrically connecting with the PCB 2, a latch mechanism 3 assembled to the housing 1, a metal shell 4 assembled to the housing 1 to partially cover the latch mechanism 3.

Please refer to FIGS. 1–9, the housing 1 of the present invention is made of metal material and comprises a base 11, a cover 12 engagble with the base 11 and a receiving space 15 formed between the base and the cover 11, 12. The metal housing 1 also comprises a rectangular base portion 13 and an elongated tongue portion 14 extending forwardly from the base portion 13.

The base 11 comprises a first base section 11*a* and a first tongue section 11*b* extending forwardly from the first base section 11*a*. The first base section 11*a* comprises a first flat portion 110, a pair of first flanges 112 and a first rear wall 113 respectively extending upwardly from opposite side edges and rear edge of the first flat portion 110. The front portions of the first flanges 112 are cut to present the first flanges 112 L-shaped. A first substantially semicircular opening 1130 is defined in the first rear wall 113 and a pair of first screw holes 1312 are defined in the first rear wall 113 and located at opposite sides of the first semicircular opening 1130. The first tongue section 11*b* comprises a first panel 118 formed with a pair of ribs 114 located at opposite sides thereof. Each rib 114 forms a tip end 1140 extending beyond a front edge of the flat portion 118. The first panel 118 also forms two pairs of first standoffs 115 spaced arranged thereon, and each first standoff 115 defines a first positioning hole 1150 therein. A pair of U-shape cutouts 117 extend rearward from the front edge of the first panel 118 and respectively locate adjacent to corresponding tip ends 1140.

The cover 12 comprises a second base section 12*a* and a second tongue section 12*b* extending forwardly from the second base section 12*a*. The second base section 12*a* comprises a second flat portion 120, a pair of second flanges 122 and a second rear wall 123 extending downwardly from opposite side edges and a rear edge of the second flat portion 120. The rear portions of the second flanges 122 and the second rear wall 123 are cut to present the second flanges 122 L-shaped. A second substantially semicircular opening 1230 is defined in the second rear wall 123. A pair of second screw holes 1232 are defined through the second rear wall 123 and locate at opposite sides of the second semicircular opening 1230. A continuous protruding ridge 1220 integrally extends downwardly from inner edges of the second flanges 122 and the second rear wall 123. The second flat portion 120 defines a first recess section 127 consisting of different-size first and second recesses 1270, 1272, and a deeper and narrower second recess section 128 formed in a front portion of the second flat portion 120 to communicate with a front surface of the second flat portion 120. A deeper slit 1280 is defined in the front portion of the second flat portion 120 and extends in a direction perpendicular to that of the second recess section 128 to communicate with the second recess section 128. A transversely-extending bar 1282 is formed at a front end of the second recess section 128 with a pair of projections 1284 arranged thereon. The upper portions of the outer periphery of the second flanges 122 and the second rear wall 123 are partially cut to form recess. A pair of rims 129 are formed at the front portion of the first flat portion 12*a*. In addition, the second panel 120 forms a plurality of steps 121 extending downwardly therefrom with different height. Another pair of second screw holes 1232 is recessed downwardly from the top surface of the second base section 12*a* a certain depth and locate at opposite sides of the second recess section 128.

The second tongue section 12*b* comprises a second panel 124 formed with a long keyway 1244 and a pair of side walls 125 extending downwardly from opposite sides of the second panel 124. A pair of second channels 1250 are defined in corresponding side walls 125 opened toward outside for guiding the insertion of the cable connector assembly 100 and positioning the cable connector assembly 100 relative to a complementary connector (not shown). A pair of protrusions 126 extend rearward from a front surface of the second tongue section 12*b* and respectively locate below the side walls 125 to form a pair of gaps 1260 therebetween. The second panel 124 forms an enhancing portion (not labeled) on a bottom surface thereof for enhancing the strength thereof and three pairs of second standoffs 1240 are symmetrically arranged on the enhancing portion with two pairs of second standoffs 1240 formed with posts 1242 extending downwardly. The first and second standoffs 115, 1240 with the first and second positioning holes 1150, 1242 are served as first engaging means of the housing 1. The first engaging means is not limited to the structures described above, it also can be protrusions protruding from the first and second tongue sections 11*b*, 12*b*, or recesses recessed from the first and second tongue sections 11*b*, 12*b*.

The PCB 2 is formed with a plurality of first conductive pads 21 aligned at a front end thereof and a plurality of second conductive pads 22 aligned at an opposite rear end thereof with different amount from that of the first conductive pads 21. The first and second conductive pads 21, 22 electrically connect with one another through inner traces disposed in the PCB 2. Two pairs of holes 23 are symmetrically arranged on the PCB 2 adjacent to the first conductive pads 21. The holes 23 are served as second engaging means of the PCB 2. The second engaging means is also not limited to the structures described above, it can be standoffs with holes to receive the respective protrusions of the first engaging means of the housing 1, or different-shape projections formed on opposite surfaces of the PCB to be received in the recesses of the first engaging means of the housing 1.

The latch mechanism 3 comprises a latch member 31 latching with the complementary connector, a pulling member 32 cooperating with the latch member 31 to actuate the latch member 31 to unlatch from the complementary connector, and an elective pull tape 33 assembled to the pulling member 32.

Particularly referring to FIG. 3, the latch member 31 is made of metal material and is a cantilever-type member. The latch member 31 comprises an N-shape engaging portion 310 located in a vertical surface, a flat latching portion 311 located in a horizontal surface perpendicular to the vertical surface and an inclined connecting portion 312 connecting the engaging portion 310 with the latching portion 311 to provide spring force to the latch member 31. The engaging portion 310 comprises a transverse bar section 3101 and a pair of side sections 3102 extending downwardly from opposite sides of the bar section 3101. Each side section 3102 is formed with barbs 3104 on outmost edge thereof. The flat latching portion 311 defines a pair of rectangular holes 3110 at a rear portion thereof adjacent to the connecting portion 312 and a pair of latches 3112 bending downwardly from opposite sides of the front edge thereof. The connecting portion 312 connects with middle portion of the bar section 3101 and extends upwardly from a lower edge of the bar section 3101. The connecting portion 312 also defines a hole therein for adjusting spring force of the latch member 31 through changing size and shape of the hole. Each of the side section 3102 and the latching portion 310 is formed with a rib 313 stamped therewith for respectively enhancing the engagement with the housing 1 and the complementary connector.

The pulling member 32 is made by insulative material and comprises a front cooperating portion 321, an elongated intermediate portion 323 extending rearward form the cooperating portion 321 and formed with an interference portion 322, and an operating portion 324 formed at a rear end of the intermediate portion 323. The interference portion 322 comprises a pair of stop sections 3212 formed at opposite sides of the intermediate portion 323 and located adjacent to the cooperating portion 321 and a pair of elastic sections 3210 formed at middle portion of the intermediate portion 323. Each elastic section 3210 comprises a transverse block section 3224 and a V-shape claw section 3226 extending rearward from the block section 3224. The cooperating portion 321 comprises a vertical section 3210 connecting the cooperating portion 321 with the intermediate portion 323 and a body section 3212 extending forwardly from a lower edge of the vertical section 3210. The body section 3212 forms a pair of upwardly extending ribs 3214 with tip end formed with enlarged protrusions 3216. A slanted surface

3218 downwardly and rearward extends from a front surface of the body section 3212. The operating portion 324 is enlarged from the intermediate portion 323 and thus, forms a pair of slanted edges 3240 for facilitating handle. The operating portion 324 also defines a rectangular slot 3242 in a main portion thereof to cooperate with the pull tape 33.

The pull tape 33 is a piece of belt with opposite ends sticked to each other to form a loop portion 330 and a rear pull portion 332. The pull tape 33 firstly protrudes through the slot 3242 of the operating portion 324 of the pulling member 32 and then sticks the opposite ends together.

The conductive shell 4 comprises a body portion 40 formed with a plurality of bars 400 on a top surface for increasing friction and a pair of lateral walls 42 extending downwardly from opposite sides of the body portion 40. Two pairs of holes 402 are respectively formed at front portion and rear portion of the body portion 40. A downwardly-extending first tab 404 is formed at a front edge of the body portion 40. A pair of second tabs 405 are formed with the body portion 40 extending downwardly from a rear edge of the body portion 40.

In assembly, conductors 70 of the cable 7 are respectively soldered to the second conductive pads 22 of the PCB 2. Then an insulator 9 is molded with the rear end of the PCB 2 and the front ends of the conductors 70. The upper portion of the insulator 9 is stepped to form more than one steps and is received in the receiving space 17 (FIG. 9) formed by the first base section 11*a* and the second base section 12*a*. The PCB 2 with the cable 7 is located on the first standoffs 115 of the base 11 with the holes 23 aligned with the first positioning holes 1150 and the cable 7 is located in the first semicircular opening 1130 of the base 11. The cable connector assembly 100 of the present invention may have a cable holder 6 grasping a metal braiding area exposed outside of the cable 7 to provide strain relief to the cable 7. The cover 12 is assembled to the base 11 and the PCB 2 with the posts 1242 protruding through the holes 23 and the first positioning holes 1150 to position the PCB 2 in the receiving space 15 of the housing 1. The PCB 2 is sandwiched between the base 1 and the cover 12 by the first and second engaging means engaging with each other. The protruding ridge 1220 of the cover 12 is received in a middle of the first flanges 112 and the first rear wall 113 of the base 11 and the pair of tip ends 1140 received in the gaps 1260, thus, the base 11 and the cover 12 are also securely assembled together. The first and second screw holes 1132, 1232 combine into a screw receiving space (not labeled).

Referring to FIGS. 5–9, the latch mechanism 3 is assembled to the second base section 12*a* of the cover 12 along a vertical direction perpendicular to the front-to-back direction. The pulling member 32 is firstly pressed to the cover 12. The cooperating portion 321 of the pulling member 32 is received in the second recess section 128 of the cover 12, and the intermediate portion 323 with the interference portion 322 are received in the first recess section 127. The stop sections 3222 and the elastic sections 3220 are respectively sliderably received in the different-size first and second recesses 1270, 1272 with the block section 3224 and claw section 3226 respectively abutting against opposite edges of the large-size second recesses 1272. The latch member 31 is assembled to the cover 12 along the vertical direction and the engaging portion 310 is interferentially received in the slit 1280 by the barbs 3104 of the side sections 3102. The inclined connecting portion 312 is located on the slanted surface 3218 of the body section 3212 of the cooperating portion 321. The bar section 3101 of the latch member 31 are located on the ribs 3214 with the enlarged protrusions 3216 located in front of the bar section 3101. The projections 1284 of the cover 12 are respectively received in the rectangular holes 3110 and the latches 3112 exposed above the second tongue section 12*b*.

When the complementary connector mates with the cable connector assembly 100 of the present invention, contacts of the complementary connector may electrically connect with the first conductive pads 21 of the PCB 2 with corresponding structure thereof latches with the latches 3112 of the latch member 31. When the cable connector assembly 100 disengages from the complementary connector, a rearward pulling force exerts to the operating portion 324 of the pulling member 31 or the pull section 332 of the pull tape 33, according to the space left for the operator to operate, to actuate the pulling member 32 rearward move with the elastic sections 3220 and the stop sections 3222 sliding in the second and first recesses 1272, 1270 until the enlarged protrusions 3216 abut against the bar section 3101 of the latch member 31. The body section 3212 also rearward moves with the slanted surface 3218 sliding along a bottom periphery of the inclined connecting portion 312, thus actuating the connecting portion 312 to pivot upwardly relative to the bar section 3101 of the engaging portion 310 and the latch section 311 with the latches 3112 to upwardly move to unlatch from the complementary connector. After the rearward pulling force is removed, restore force of the elastic sections 3220 actuates the pulling member 32 to move forwardly to its original position, and thus, the latch member 31 also reverts to its original position. That is to say, when the space left for the operator is large enough, the operator may pull the pulling member 32 or the pull tape 33 to drive the latch member 31 to unlatch from the complementary connector; when the space left for the operator is small, the operator may pull the pull tape 33 to separate the cable connector assembly 100 from the complementary connector.

The conductive shell 4 is finally assembled to the second base section 12*a* of the cover 12 with the lateral walls 42 and the second tabs 405 respectively received in the recess formed by the second flanges 122 and the second rear wall 123. A front edge of the conductive shell abuts against the rims 129 and the first tab 404 is received in the second recess section 128 of the cover 12. The first tab 404 also presses on the latch member 31 to provide extra return force to the latch member 31 when disengaging the cable connector assembly 100 from the complementary connector. A pair of first screws 80 are screwed through the holes 402 of the shell 4, the second screw holes 1232 of the cover 12 and the first screw holes 1132 of the base 11 to retain the shell 4 with the base 11 and the cover 12, and a pair of second screws 82 are screwed through the holes 402 in front end of the shell and the pair of second screw holes 1232 of the cover 12 located at opposite sides of the second recess section 128 to enhancing the engagement between the conductive shell 4 and the cover 12.

The cable connector assembly 100 of the present invention may have an EMI gasket 5 assembled to the metal housing 1 for reducing the Electro Magnetic Interference (EMI) in the signal transmission. The gasket 5 is a rectangular frame and stamped from a metal sheet. The gasket 5 comprises a continuous periphery wall 50 consisting of a pair of opposite longitudinal edges 501 and a pair of side edges 502 respectively connecting with the longitudinal edges 501. The gasket 5 also defines a space 51 circumscribed by the periphery wall 50. The gasket 5 is assembled to the front surface of he base portion 13 of the housing 1 with the tongue portion 14 protruding through the space 51. The upper longitudinal edge 501 of the gasket 5 is partially cut to form a recess 53 substantially equal to the width of the latching portion 310 to permit the latching portion 310 locating above the tongue portion 14.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a housing;

a plurality of conductive contacts located in the housing;

a cable electrically connecting with the conductive contacts;

a pulling member moveable relative to the housing in a horizontal direction and comprising a front cooperating portion and a rear operating portion;

a latch member discrete from the pulling member and assembled to the housing for latching with a complementary connector, the latch member comprising an engaging portion assembled to the housing, a connecting portion extending from the engaging section and capable of being actuated by the cooperating portion of the pulling member, and a front latching portion extending forwardly from at least one of the engaging portion and the connecting portion for latching to the complementary connector; and a pull tape assembled to at least one of the operating portion of the pulling member and the latch member for separating the cable connector assembly from the complementary connector; and wherein the housing comprises a base portion, and a tongue portion extending forwardly from the base portion, and wherein the pulling member and the latch member are assembled to the base portion of the housing.

2. The cable connector assembly as claimed in claim 1, wherein the latch member is vertically planted into a top surface of the base portion and the latching portion thereof partially extends beyond a front surface of the base portion to locate above the tongue portion.

3. The cable connector assembly as claimed in claim 1, wherein the operating portion of the pulling member is exposed beyond the base portion of the housing and the pull tape is wholly exposed beyond the base portion of the housing.

4. The cable connector assembly as claimed in claim 1, wherein the latch member is operated in a lever manner.

5. The cable connector assembly as claimed in claim 1, the housing comprises a base portion and a tongue portion extending from the base portion, and wherein an EMI gasket is assembled to the front surface of the base portion.

6. The cable connector assembly as claimed in claim 1, the housing comprise a base portion and a tongue portion extending from the base portion, and wherein the tongue portion defines at least one long keyway and at least one channel extending along a mating direction of the cable connector assembly adapted for guiding insertion.

7. The cable connector assembly as claimed in claim 1, wherein the engaging portion of the latch member locates in a vertical surface and the latching member locates in a horizontal surface, and wherein the housing comprises a base portion and a tongue portion extending from the base portion, the base portion defines a slit vertically extending a certain distance from a top surface thereof to receive the engaging portion of the latch member.

8. The cable connector assembly as claimed in claim 7, wherein engaging portion is of n-shape and comprises a bar section from which the connecting portion extends and a pair of side portions formed with barbs to interferentially engage with the slit.

9. The cable connector assembly as claimed in claim 1, wherein the cooperating portion of the pulling member forms a slanted surface located below the connecting portion of the latch member and capable of sliding along the connecting portion to actuate the latching portion pivotally move relative to the engaging portion to separate from the complementary connector.

10. The cable connector assembly as claimed in claim 9, wherein the pulling member further comprises an intermediate portion connecting the cooperating portion with the operating portion, and wherein the intermediate portion is formed with at least one elastic section for providing restore force to the pulling member and the latch member.

11. The cable connector assembly as claimed in claim 10, wherein the base portion of the housing defines at least one recess section in the top surface thereof, and wherein said elastic section of the pulling member is capable of sliding in the at least one recess section.

12. The cable connector assembly as claimed in claim 1, further comprising a conductive shell assembled to the housing to partially shield the latch member and the pulling member.

13. The cable connector assembly as claimed in claim 12, wherein the conductive shell comprises a downwardly-extending tab formed at a front thereof to locate above the latching portion of the latch member for providing extra restore force to the latch member.

14. The cable connector assembly as claimed in claim 1, further comprising a PCB received in the housing and wherein the contacts are first and second conductive pads formed at front and rear ends of the PCB.

15. The cable connector assembly as claimed in claim 14, wherein the cable comprises a plurality of conductors electrically connecting with the second conductive pads of the PCB, and the cable connector assembly further comprises an insulator molded with the rear end of the PCB and front ends of the conductors.

16. A cable connector assembly adapted for electrically connecting with a complementary connector comprising:

a housing defining a mating port;

a plurality of conductive elements disposed in the mating port;

a cable linked to a rear side of the housing and electrically connected to the corresponding conductive elements, respectively;

a transversely moveable latch structure located on an exterior side of the housing and capable of moving toward an exclusive first direction when disengaging from said complementary connector and moving toward an exclusive second direction when reverting to its original position, and wherein the exclusive first direction is opposite to the exclusive second direction;

a first pulling member associated with a rear portion of the latch for transversely moving the latch along the exclusive first and second directions; and a second pulling member associated with a rear portion of the first pulling member and defining a finger grasping region for a user; wherein said second pulling member is soft while said first pulling member is stiff.

17. The assembly as claimed in claim 16, wherein both said second pulling member and said second pulling member essentially move rearwardly, and the exclusive first direction is an upward direction, while the exclusive second direction is an downward direction, and wherein the first and second directions are both perpendicular to the movement directions of the first and second pulling members.

18. The assembly as claimed in claim 16, wherein a conductive shell is attached to the housing so that said first pulling member is hidden under a conductive shell and essentially sandwiched between the housing and said conductive shell while the second pulling member is essentially exposed an exterior outside of the housing.

19. A cable connector assembly comprising:

a housing;

a plurality of conductive contacts located in the housing;

a cable electrically connecting with the conductive contacts;

a pulling member moveable relative to the housing in a horizontal direction and comprising a front cooperating portion and a rear operating portion;

a latch member discrete from the pulling member and assembled to the housing for latching with a complementary connector, the latch member comprising an engaging portion assembled to the housing, a connecting portion extending from the engaging section and capable of being actuated by the cooperating portion of the pulling member, and a front latching portion extending forwardly from at least one of the engaging portion and the connecting portion for latching to the complementary connector; and a pull tape assembled to at least one of the operating portion of the pulling member and the latch member for separating the cable connector assembly from the complementary connector;

further comprising a conductive shell assembled to the housing to partially shield the latch member and the pulling member.

20. The cable connector assembly as claimed in claim 19, wherein the operating portion of the pulling member defines a slot therein, and wherein the pull tape protrude through the slot to form a front loop portion cooperating with the operating portion of the pulling member and a pull portion.

* * * * *